US006364626B1

(12) United States Patent
Popov

(10) Patent No.: US 6,364,626 B1
(45) Date of Patent: Apr. 2, 2002

(54) LIQUID-GAS JET APPARATUS

(75) Inventor: Serguei A. Popov, 4615 Post Oak Pl., Suite 140 Houston, TX (US) 77027

(73) Assignees: Evgueni D. Petroukhine, Limassol (CY); Serguei A. Popov, Budapest (HU)

( * ) Notice: Subject to any disclaimer, the term of this patent is extended or adjusted under 35 U.S.C. 154(b) by 0 days.

(21) Appl. No.: 09/402,520

(22) PCT Filed: Feb. 1, 1999

(86) PCT No.: PCT/IB99/00179

§ 371 Date: Oct. 4, 1999

§ 102(e) Date: Oct. 4, 1999

(87) PCT Pub. No.: WO99/40326

PCT Pub. Date: Aug. 12, 1999

(30) Foreign Application Priority Data

Feb. 5, 1998 (RU) ..... 98101928

(51) Int. Cl.[7] ..... F04F 5/44
(52) U.S. Cl. ..... 417/196; 417/151
(58) Field of Search ..... 417/151, 196

(56) References Cited

U.S. PATENT DOCUMENTS 2,582,069 A 1/1952 Rose
3,625,820 A * 12/1971 Gluntz et al. ..... 417/198
5,628,623 A 5/1997 Skaggs

FOREIGN PATENT DOCUMENTS

| | | |
|---|---|---|
| RU | 2016262 | 7/1994 |
| SU | 985462 | 12/1982 |
| SU | 1483106 | 5/1989 |

OTHER PUBLICATIONS

Lyamaev B.F., "Hydrojet pumps and apparatuses" book, 1988, USSR, Leningrad, "Mashinostroenie" Publishing house, pp. 22, 90.

* cited by examiner

*Primary Examiner*—Cheryl J. Tyler
(74) *Attorney, Agent, or Firm*—Mark A. Oathout

(57) ABSTRACT

A liquid-gas jet apparatus has an axisymmetric active nozzle and a mixing chamber. When the ratio between the surface area of the cross-section of the mixing chamber's throat and the surface area of the cross-section of the nozzle's throat ranges from 10 to 200, then the value of the radial and angular misalignment between the nozzle and the mixing chamber varies from 0.1 mm to 12 mm and from 2" to 5°30', respectively. When the ratio of the surface area of the cross-section of the mixing chamber's throat to the surface area of the cross-section of the nozzle's throat ranges from 200 to 1600, then the value of the radial and angular misalignment between the active nozzle and the mixing chamber varies from 0.14 mm to 25 mm and from 2.5" to 10°30', respectively. A Jet apparatus realized according to the above-mentioned dimensions exhibits an improved operational efficiency.

1 Claim, 1 Drawing Sheet

LIQUID-GAS JET APPARATUS

BACKGROUND

The present invention pertains to the field of jet technology, primarily to liquid-gas jet devices for producing and maintaining a vacuum.

A liquid-gas ejector is known, which comprises an asymmetrical active nozzle and a mixing chamber where the active nozzle has a curvilinear axis (see, Lyamaev B. F., "Hydro-jet Pumps and Units", Leningrad, "Mashinostroenie" Publishing house, 1988, page 22).

Such an ejector allows for more effective utilization of energy of an active medium due to formation of an irregular field of velocities in the ejector's mixing chamber. But the asymmetrical field of velocities in the mixing chamber results in the appearance of reverse flows which negatively affect the ejectors operation.

The closest analogue of the ejector introduced in the present invention is a liquid-gas ejector having an axisymmetric nozzle and a mixing chamber (see, Lyamaev B. F., "Hydro-jet Pumps and Units", Leningrad, "Mashinostroenie" Publishing house, 1988, page 90).

This liquid-gas ejector is able to evacuate various gaseous mediums, to produce a vacuum and to compress gaseous mediums. However, the amount or value of misalignment between the active nozzle and the mixing chamber, arising during the ejector's manufacture, significantly affects the ejector's performance. This misalignment results in an irregular field of velocities during mixing of the liquid and gaseous mediums and compression of the gaseous medium, and can provoke contraction of the range of stable operation of the ejector and a decrease of its reliability.

SUMMARY OF THE INVENTION

One objective of the present invention is to increase the ejector's reliability in a wide range of pressures and in a wide range of the ejector's geometry.

The objective is achieved as follows: a liquid-gas ejector, having an axisymmetric nozzle and a mixing chamber and having a ratio of the surface area of the cross-section of the mixing chamber's throat to the surface area of the cross-section of the nozzle's throat from 10 to 200, and having the values of the radial and angular misalignment between the active nozzle and the mixing chamber from 0.1 mm to 12 mm and from 2" to 5°30' respectively. When the ratio of the surface area of the cross-section of the mixing chamber's throat to the surface area of the cross-section of the nozzle's throat ranges from 200 to 1600, then the radial and angular misalignment between the active nozzle and the mixing chamber may vary from 0.14 mm to 25 mm and from 2.5" to 10°30' respectively.

During experimental research it was discovered, that the ejector's performance to a great extent depends on how precisely the radial and angular alignment between the active nozzle and successive flow-through channel of the ejector are maintained. A mixing chamber or, in some cases, a mixing chamber with an outlet diffuser are understood as the successive flow-through channel of the ejector. It was also discovered, that the precise requirements for the radial and angular coaxiality of the nozzle and mixing chamber are most strict for ejectors which have the ratio between the cross sectional area of the mixing chamber's throat and the cross sectional area of the nozzle's throat range from 10 to 200. In this case the radial misalignment, which is understood as the distance between the longitudinal axis of the nozzle and the longitudinal axis of the mixing chamber in a radial direction, must be from 0.1 mm to 12 mm, the angular misalignment, which is understood as an angle subtended by the long axis of the nozzle and the long axis of the mixing chamber, must be from 2" to 5°30'. If the ratio between the surface area of the cross-section of the mixing chamber's throat and the surface area of the cross-section of the nozzle's throat varies from 200 to 1600, then the precision requirements recited above for coaxiality are lower and make from 0.14 mm to 25 mm for the radial misalignment and from 2.5" to 10°30' for the angular misalignment.

The difference between the precision requirements for the ejectors with differing geometries is determined by some operational features of the process of the liquid-gas jet apparatuses.

As a rule, the nozzle of the liquid-gas jet apparatus having a low ratio between the surface area of the cross-section of the mixing chamber's throat and the surface area of the cross-section of the nozzle's throat produces a less dispersed liquid jet and such apparatuses are used not only for evacuation of gaseous mediums but also for compression. Under these conditions loss of coaxiality and consequent formation of an asymmetric field of velocities during mixing of liquid and gaseous mediums can result in the appearance of reverse flows in the mixing chamber under the influence of backpressure and, in the upshot, in disruption of the apparatus' operation. Tests have shown, that if the ratio between the surface area of the cross-section of the mixing chamber's throat and the surface area of the cross-section of the nozzle's throat is 200, then the maximum permissible radial and angular misalignment between the active nozzle and the mixing chamber, which still provides stable operation of the jet apparatus, must not be more than 12 mm and 5°30', respectively. At the same time it is necessary to take into account that highly precise manufacture of the ejector and the attainment of practically no misalignment of its nozzle and mixing chamber results in an abrupt rise in the manufacturing cost of the apparatus. Therefore, the lowest permissible levels of the radial and angular misalignment, which do not bring about a significant deterioration of performance of the apparatus and a significant increase in the cost of its manufacture, were also discovered during the tests. These minimal radial and angular misalignments are 0.1 mm and 2" respectively.

Another view may be observed during operation of the liquid-gas jet apparatuses with the ratio of the surface area of the cross-section of the mixing chamber's throat to the surface area of the cross-section of the nozzle's throat ranging from 200 to 1600. A highly dispersed jet of an active liquid is provided to ensure stable operation of jet apparatuses of this type. Consequently such jet apparatuses are used for evacuation and compression of a gaseous medium under lower backpressure conditions. A "cloud", generated behind the outlet of the nozzle and composed of the motive liquid drops, is transformed in the mixing chamber into a gas-drop flow constituting a mixture of the motive and gaseous mediums. This flow is less sensitive to the misalignment between the mixing chamber and the active nozzle. The tests have shown, that when the ratio of the surface area of the cross-section of the mixing chamber's throat to the surface area of the cross-section of the nozzle's throat ranges from 200 to 1600, then the maximum radial and angular misalignment of the nozzle and mixing chamber must not exceed 25 mm and 10°30', respectively. As for the minimal permissible misalignment, during research it was discovered that the jet apparatus tolerates the minimal radial misalignment between the nozzle and mixing chamber of 0.14 mm and the minimal angular misalignment of 2.5" without degradation of the performance and operational stability.

So, the dependence between the geometry of the liquid-gas jet apparatus and the permissible values of radial and angular misalignment of the apparatus' nozzle and mixing chamber, which allow effective operation of the jet apparatus during evacuation and compression of gaseous and gas-vapor mediums, was discovered during the experiments.

It is necessary to note, that the discovered correlations are valid both for single-nozzle liquid-gas jet apparatuses and for multi-nozzle liquid-gas jet apparatuses having a common receiving chamber, several nozzles and several mixing chambers or mixing chambers with outlet diffusers aligned with the nozzles.

DETAILED DESCRIPTION OF THE PREFERRED EMBODIMENT(S)

Figure 1:
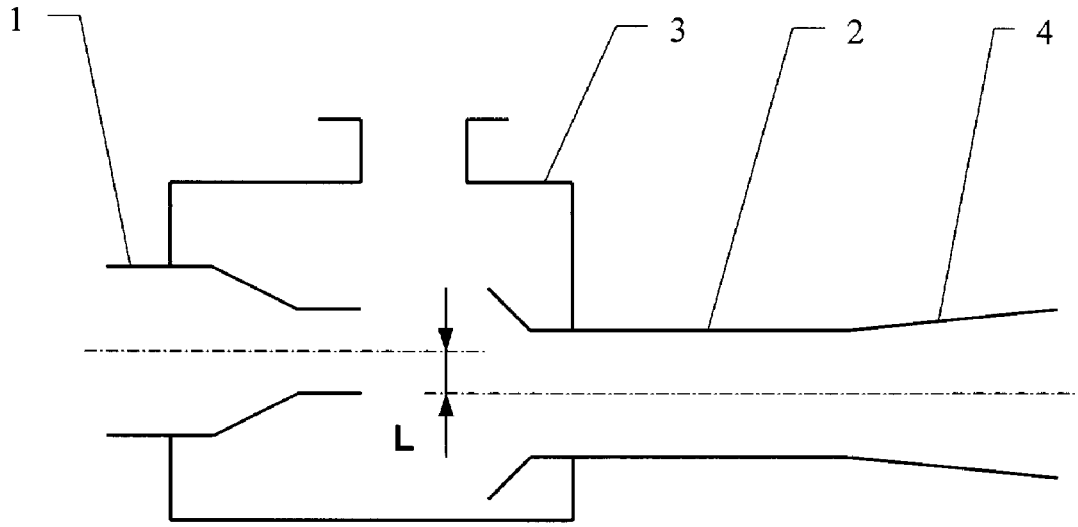
FIG. 1 represents a schematic diagram of a liquid-gas ejector with a radial misalignment between the nozzle and the mixing chamber.
Figure 2:
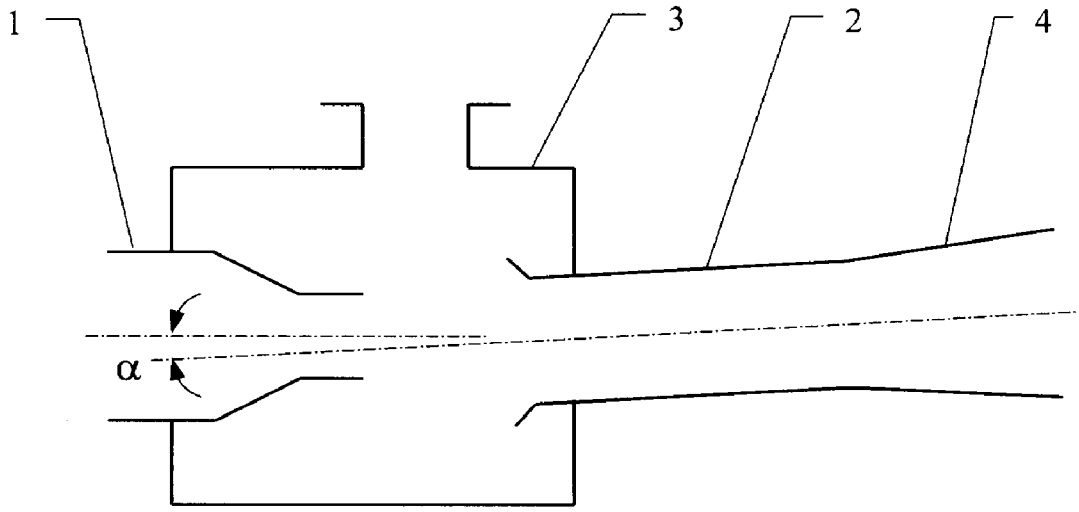
FIG. 2 represents a schematic diagram of a liquid-gas jet apparatus with an angular misalignment between its nozzle and the mixing chamber.

The liquid-gas jet apparatus comprises an axisymmetric active nozzle 1 and a mixing chamber 2. If the ratio of the surface area of the cross-section of the throat of the mixing chamber 2 to the surface area of the cross-section of the throat of the nozzle 1 ranges from 10 to 200, then the radial misalignment "L" between the active nozzle 1 and the mixing chamber 2 varies from 0.1 mm to 12 mm and the angular misalignment "α" varies from 2" to 5°30'. If the ratio of the surface area of the cross-section of the throat of the mixing chamber 2 to the surface area of the cross-section of the throat of the nozzle 1 ranges from 200 to 1600, then the radial misalignment "L" between the active nozzle 1 and the mixing chamber 2 must be from 0.14 mm to 25 mm and the angular misalignment "α" must be from 2.5" to 10°30'.

Besides the mentioned active nozzle 1 and mixing chamber 2, the liquid-gas jet apparatus can be furnished with a receiving chamber 3 and a diffuser 4.

The liquid-gas jet apparatus operates as follows.

A motive liquid medium flowing from the nozzle 1 entrains an evacuated gaseous medium into the mixing chamber 2 and mixes with the gaseous medium. During mixing, the gaseous medium is compressed due to the partial transformation of kinetic energy of the motive liquid into pressure energy. A mixture of the mediums flows from the mixing chamber 2 into the diffuser 4, where kinetic energy of the mixture is partly converted into pressure. From the diffuser 4 the mixture passes to a destination.

INDUSTRIAL APPLICABILITY

The described liquid-gas jet apparatus can be applied in chemical, petrochemical, agricultural and any other industries, where evacuation and compression of gaseous and gas-vapor mediums are required.

What is claimed is:

1. A liquid-gas jet apparatus, comprising:

an axisymmetric active nozzle mounted adjacent a mixing chamber;

wherein the active nozzle and the mixing chamber define a radial misalignment between the active nozzle and the mixing chamber, an angular misalignment between the active nozzle and the mixing chamber, and a ratio of a cross-sectional area of the mixing chamber's throat to a cross-sectional area of the nozzle's throat;

wherein the values of the radial misalignment, the angular misalignment, and the ratio of the cross-sectional area of the mixing chamber's throat to the cross-sectional area of the nozzle's throat are selected from the group consisting of:

the radial misalignment ranges from 0.1 mm to 12 mm, the angular misalignment ranges from 2" to 5°30', and the ratio of the cross-sectional area of the mixing chamber's throat to the cross-sectional area of the nozzle's throat ranges from 10 to 200; and the radial misalignment ranges from 0.14 mm to 25 mm, the angular misalignment ranges from 2.5" to 10°30', and the ratio of the cross-sectional area of the mixing chamber's throat to the cross-sectional area of the nozzle's throat ranges from 200 to 1600.

* * * * *